US010989451B2

(12) United States Patent
Durrani et al.

(10) Patent No.: US 10,989,451 B2
(45) Date of Patent: Apr. 27, 2021

(54) OIL MANAGEMENT IN A REFRIGERATION SYSTEM—COMPRESSOR OIL COOLER INTEGRATED INTO GASCOOLER

(71) Applicant: Hanon Systems, Daejeon (KR)

(72) Inventors: Navid Durrani, Elsdorf (DE); Toni Spies, Cologne (DE); Daniel Zens, Kreuzau (DE); Roberto Della Rovere, Montebello di Bertona (IT); Herr René Junker, Kerpen (DE); Christoph Bara, Cologne (DE); Martin Hötzel, Ratingen (DE); Martina Paduch, Wesseling (DE); Marc Graaf, Krefeld (DE); Peter Heyl, Cologne (DE)

(73) Assignee: HANON SYSTEMS, Daejeon (KR)

( * ) Notice: Subject to any disclaimer, the term of this patent is extended or adjusted under 35 U.S.C. 154(b) by 196 days.

(21) Appl. No.: 15/375,244

(22) Filed: Dec. 12, 2016

(65) Prior Publication Data

US 2017/0167764 A1 Jun. 15, 2017

(30) Foreign Application Priority Data

Dec. 11, 2015 (DE) ..... 102015121583.7

(51) Int. Cl.
*F25B 43/02* (2006.01)
*F25B 31/00* (2006.01)
(Continued)

(52) U.S. Cl.
CPC ..... *F25B 31/004* (2013.01); *F25B 39/00* (2013.01); *F25B 39/04* (2013.01); *F25B 43/02* (2013.01);
(Continued)

(58) Field of Classification Search
CPC .... F25B 40/04; F25B 31/008; F28D 1/05308; F28D 1/05358; F28D 1/0408; F28F 9/0231
(Continued)

(56) References Cited

U.S. PATENT DOCUMENTS 1,764,190 A * 6/1930 Bell ..... C10G 7/00 165/140
1,903,951 A * 4/1933 Williams ..... F25B 49/022 62/204
(Continued)

FOREIGN PATENT DOCUMENTS

DE 9207991 U1 9/1992
DE 102006038726 A1 2/2008
(Continued)

*Primary Examiner* — Edward F Landrum
*Assistant Examiner* — Alexis K Cox
(74) *Attorney, Agent, or Firm* — Shumaker, Loop & Kendrick, LLP; James D. Miller

(57) ABSTRACT

A heat-exchanger including a device for separating oil from a coolant-oil mixture and cooling the oil and cooling and/or liquefying the coolant. The heat exchanger features a first area cooling and/or liquefying the coolant, and a second area cooling the oil. The heat exchanger further features at least two manifolds. The first area of the heat exchanger features flow channels guiding the coolant, and the second area of the heat exchanger features flow channels guiding the oil. The flow channels extend between the manifolds. Each of the flow channels has a respective outside flooded by a heat-absorbing fluid.

9 Claims, 5 Drawing Sheets

(51) Int. Cl.

| | |
|---|---|
| ***F28D 1/053*** | (2006.01) |
| ***F28D 1/04*** | (2006.01) |
| ***F25B 39/00*** | (2006.01) |
| ***F25B 39/04*** | (2006.01) |
| ***F28F 9/02*** | (2006.01) |
| *F28D 21/00* | (2006.01) |

(52) U.S. Cl.
CPC ..... *F28D 1/0443* (2013.01); *F28D 1/05375* (2013.01); *F28F 9/0234* (2013.01); *F25B 2400/02* (2013.01); *F25B 2500/16* (2013.01); *F25B 2500/18* (2013.01); *F28D 2021/007* (2013.01)

(58) Field of Classification Search
USPC ..... 165/140
See application file for complete search history.

(56) References Cited

U.S. PATENT DOCUMENTS

| | | | | |
|---|---|---|---|---|
| 6,058,727 | A | 5/2000 | Fraser, Jr. et al. | |
| 6,579,335 | B2 | 6/2003 | Ollinger | |
| 7,591,148 | B2 * | 9/2009 | Sanada | F25B 39/04 165/140 |
| 8,726,651 | B2 * | 5/2014 | Leijon | F03B 17/063 60/497 |
| 2002/0134102 | A1 * | 9/2002 | Morimoto | B01D 45/12 62/470 |
| 2003/0005667 | A1 | 1/2003 | Ollinger | |
| 2006/0042282 | A1 * | 3/2006 | Ludwig | F25B 41/04 62/222 |
| 2006/0060327 | A1 * | 3/2006 | Yu | F16H 57/04 165/70 |
| 2009/0272515 | A1 * | 11/2009 | Wu | F02B 29/0462 165/140 |
| 2010/0251756 | A1 | 10/2010 | Scarcella et al. | |
| 2015/0345844 | A1 * | 12/2015 | Koster | F25B 31/004 62/512 |
| 2016/0136555 | A1 * | 5/2016 | Yoshioka | F25B 31/002 62/470 |

FOREIGN PATENT DOCUMENTS

| | | | |
|---|---|---|---|
| JP | 05312437 | A | 11/1993 |
| JP | 11173706 | A | 7/1999 |
| JP | 2001174102 | A | 6/2001 |
| JP | 2004308968 | A | 11/2004 |
| JP | 2006226590 | A | 8/2006 |
| JP | 2011510258 | A | 3/2011 |
| KR | 1020090045473 | A | 5/2009 |

* cited by examiner

OIL MANAGEMENT IN A REFRIGERATION SYSTEM—COMPRESSOR OIL COOLER INTEGRATED INTO GASCOOLER

CROSS-REFERENCE TO RELATED PATENT APPLICATION

This patent application claims the benefit of German Patent Application DE 10 2015 121 583.7 filed Dec. 11, 2015, the disclosure of which is hereby incorporated herein by reference in its entirety.

FIELD OF THE INVENTION

The invention pertains to a device for separating the oil from a coolant-oil mixture and for the cooling of the oil and for the cooling and/or liquefying of the coolant in a cooling circuit. The cooling circuit features a compressor, as well as a heat exchanger, which is positioned downstream from the compressor in the direction of the flow of the coolant, a device for separating the oil, as well as a heat exchanger for cooling the separated oil.

BACKGROUND OF THE INVENTION

Within a cooling circuit, the oil has multiple functions. On the one hand, the oil serves as a lubricant for moving components positioned inside the compressor, thereby reducing the friction between the components, which specifically consist of metal parts. This reduces the wear and tear on the compressor. On the other hand, the oil serves to improve the sealing of the compressor from its environment, as well as the internal sealing between the high-pressure area and the low-pressure area of the coolant inside the compressor. A further function of the oil in the cooling circuit is to absorb and conduct the heat generated inside the compressor, for instance as a result of friction between moving parts of the compressor.

Even though essentially the oil is only needed inside the compressor, it is inevitable that the oil also circulates within the cooling circuit. The quantity of circulating oil depends on multiple factors here. These factors include, among other things, the design or the construction and configuration of the compressor and of the periphery, that is, in particular, of the cooling circuit, the age of the compressor, the degree of wear and tear on it, the operating conditions and the system conditions, as well as the miscibility of the oil with the coolant.

In cooling circuits known from prior art, the circulation rate of the oil varies between 1% and 15% of the mass flow of the coolant. The oil of the compressor, which circulates through the cooling circuit together with the coolant, has a variety of effects. For instance, it changes the quality as well as the physical and thermodynamic properties of the coolant-oil mixture. The presence of the oil reduces the effectiveness of the heat exchanger of the cooling circuit, since the heat transfer and therefore the heat throughput are affected when the heat exchange surfaces on the inside of the heat exchanger are covered with an oil film, since the oil film has the effect of an additional insulation layer.

Under certain circumstances, the oil may be retained in so-called oil traps of the cooling circuit, which generate in particular in areas in which low coolant speeds. The oil accumulating in the oil traps may suddenly overflow like a vibrating liquid column and flow back to the compressor. This may generate a pressure wave, which in turn generates liquid slugging.

In low temperature applications, the ability of the oil to move within the cooling circuit is severely restricted due to the increased viscosity at low temperatures. The drop of the oil level within the compressor may lead to irreversible mechanical damage to the compressor.

Furthermore, the essentially incompressible oil does not cool down in the course of a negligible expansion process. The oil is mixed with the coolant, with part of the coolant evaporating. In this, part of the cooling capacity of the coolant, specifically, approx. 8% to 10%, is used for the cooling of the compressor oil.

In U.S. Pat. No. 6,058,727 A, a cooling circuit is described for the cooling of air with a compressor, a condenser, an expansion element, and an evaporator. The cooling circuit further features a flow path for recycling oil from the outlet of the compressor to the inlet of the compressor, with an oil separator and an oil cooler. The oil that was heated with the compression of the gaseous coolant is cooled before it is let into the compressor. The heat of the oil is transferred to the coolant suctioned in by the compressor. The oil cooler is embodied with an internal heat exchanger as a heat exchanger unit. The heat exchanger unit may be positioned inside an accumulator of the coolant.

U.S. Pat. Appl. Pub. No. 2010/0251756 A1 also discloses a cooling circuit for the cooling of air with a compressor, a condenser, an expansion element, and an evaporator, as well as a flow path for the recycling of oil from the outlet of the compressor to the inlet of the compressor, with an oil separator and an oil cooler. The oil cooler is embodied as an oil-air heat exchanger and positioned downstream from the compressor in the flow direction of the air. The heat of the oil is transferred to the air that was cooled when it flowed through the compressor.

U.S. Pat. No. 6,579,335 B2 describes a device for compressing a gaseous fluid with components for separating oil from the compressed gas, for cooling the oil after the compression of the gas, and for storing the oil. The oil is fed back into the compressor with the gaseous fluid meant to be compressed. For cooling the oil, the oil is guided through a heat exchanger, where the heat of the oil is transferred to the gaseous fluid meant to be compressed. Subsequently, the gaseous fluid is compressed.

The oil separator, the oil cooler, and the oil reservoir are all arranged into a shared housing. The oil is guided from the oil reservoir to the compressor via a connecting line.

In traditional cooling circuits, the coolant-oil mixture is guided through the heat exchanger that is positioned downstream from the compressor. Moreover, it is known from prior art [how] to separate the coolant-oil mixture after its exit from the compressor into a coolant component and an oil component. The separated oil is then cooled by heat exchange with the coolant circulating in the cooling circuit or with the air conditioned in the evaporator, which reduces the efficiency of the cooling circuit.

The task of the invention consists in providing a device for separating the oil from a coolant-oil mixture and for the cooling of the oil and for the cooling and/or liquefying of the coolant in a cooling circuit. The device should be space-saving and allow for efficient and safe operation of the cooling circuit. Furthermore, the manufacturing, maintenance, and assembly costs of the device should be minimal.

SUMMARY OF THE INVENTION

The task is solved by the subject of the invention with the characteristics shown and described herein.

The task is solved by a device according to the invention for separating oil from a coolant-oil mixture and for the cooling of the oil and for the cooling and/or liquefying of the coolant in a cooling circuit. The cooling circuit features a compressor, as well as a heat exchanger, which is positioned downstream from the compressor in the direction of the flow of the coolant, a device for separating the oil, as well as a heat exchanger for cooling the separated oil.

According to the concept of the invention, the heat exchanger features a first area for cooling and/or liquefying the coolant, and a second area as a heat exchanger for cooling the oil. The second area of the heat exchanger for cooling the oil is embodied as an integral component of the heat exchanger. The heat exchanger further features at least two manifolds.

The first area of the heat exchanger of the device according to the invention features flow channels for guiding the coolant, and the second area of the heat exchanger features flow channels for guiding the oil. The flow channels extend between the manifolds, and on one respective outward-facing side they are surrounded by a flow of a heat-absorbing fluid.

By means of the device according to the invention, the oil separated out of the coolant-oil mixture and the coolant can be cooled separately from each other in different mass flows, with the different mass flows of oil and coolant being conditioned in a shared component of the cooling circuit. The conditioning of the oil and of the coolant is accomplished in two separated areas within the heat exchanger.

By way of a driving potential for cooling the two components, and therefore as a heat-absorbing fluid, the ambient air or the coolant from a cooling circuit are advantageously used. When using the cooling circuit in an air conditioning system of a motor vehicle, the coolant may circulate, for example, within a low temperature cooling circuit or within a high temperature cooling circuit.

According to a further development of the invention, the flow channels of the first area of the heat exchanger and the flow channels of the second area of the heat exchanger are each arranged in a single plane.

According to a first alternative embodiment of the invention, the flow channels of the first area of the heat exchanger and the flow channels of the second area of the heat exchanger form a joint plane, with the heat-absorbing fluid flowing around the flow channels of the first area and the flow channels of the second area essentially in parallel.

The parallel flowing of the heat-absorbing fluid around the outsides of the different areas of the heat exchanger must be understood as meaning that the flow channels of the first area and the flow channels of the second area of the heat exchanger are charged independently of each other, meaning, for example, charged by partial mass flows of the heat-absorbing fluid.

According to a second alternative embodiment of the invention, the flow channels of the first area of the heat exchanger and the flow channels of the second area of the heat exchanger form different planes. The planes are arranged parallel to and spaced from each other, with the heat-absorbing fluid flowing around the flow channels of the first area and around the flow channels of the second area essentially consecutive.

The consecutive flowing of the heat-absorbing fluid around the outsides of the different areas of the heat exchanger must be understood as meaning that the flow channels of the first area and the flow channels of the second area of the heat exchanger are charged serially, and are therefore dependent on each other. The heat-absorbing fluid first flows as a mass flow around the flow channels of the first area and subsequently around the flow channels of the second area, or vice versa.

A preferred embodiment of the invention consists in that the device for separating the oil is devised as being integrated inside the first manifold of the heat exchanger. The first manifold features an inlet for the coolant-oil mixture, such that the device is positioned downstream from the compressor in the flow direction of the coolant-oil mixture, and upstream from the various areas of the heat exchanger for conditioning the oil and the coolant.

Accordingly, the oil is separated from the coolant-oil mixture within the heat exchanger with the area functioning as a condenser/gas cooler and with the area functioning as an oil cooler.

Alternatively, the device for separating the oil in the cooling circuit may also be positioned outside of the heat exchanger, specifically between the compressor and the inlet to the heat exchanger.

According to a first alternative embodiment of the invention, the device for separating the oil is devised as a cyclone separator; the coolant-oil mixture flowing tangentially into the device.

The device for separating the oil is advantageously equipped with a wall shaped in the form of a truncated cyclical cone. An area fully enclosed by this wall features a flow area for the coolant-oil mixture intended to be separated which increases or decreases in the flow direction.

Alternatively, the wall may also be devised as a circular cylinder, such that the area fully enclosed by this wall features a constant area for the coolant-oil mixture intended to be separated.

According to a further development of the invention, the device for separating the oil features a spirally winding flow path with a gradient. Depending on the design of the gradient, the flow path features a flow area for the coolant-oil mixture intended to be separated which increases, decreases, or is consistent in the flow direction.

According to a second alternative embodiment of the invention, the device for separating the oil features an inlet for receiving the coolant-oil mixture, a deflector plate, at least one chamber, and a J-shaped tube for diverting the coolant. The deflector plate, which delimits an upper branch, a lower branch, and the chamber, is preferentially positioned perpendicular to the flow direction of the coolant-oil mixture, downstream from the inlet. The upper branch advantageously leads into the chamber, the chamber featuring a larger flow cross section than the upper branch.

According to a preferred embodiment of the invention, the device for separating the oil features a device for sealing the connecting line to the compressor, such that the mass flow of the separated oil to the compressor can be regulated.

The regulatable and sealable connection to the compressor prevents a possible undesirable bypass between the coolant on the high-pressure side at the outlet of the compressor and the coolant on the low-pressure side at the inlet of the compressor inside the oil return [unit].

The device for sealing the connecting line to the compressor is advantageously embodied as a float.

Furthermore, the flow channels of the first area of the heat exchanger are preferentially designed as flat tubes, and the flow channels of the second area of the heat exchanger are preferentially designed as finned tubes or as flat tubes.

Fins are preferentially positioned between adjacently positioned flat tubes in an area.

It should be specified that the cooling circuit can be operated as a component of a compression refrigeration system as well as of a heat pump, so that the device according to the invention can be operated as part of a cooling circuit of a compression refrigeration system as well as of a heat pump system, and specifically, of an air conditioning system of a motor vehicle.

The device can advantageously be used with different coolants, such as R134a, R1234yf, R744, R600a, R290, R152a, or R32, as well as their mixtures, and be adjusted to a specific coolant.

In summary, the device according to the invention also features the following additional advantages:

- Reduction of the pressure loss of the coolant when flowing through the heat exchangers, since the coolant and the oil flow separately from each other through the heat exchanger, rather than as a coolant-oil mixture, and therefore also an
- Increase of the operational efficiency and safety of the system, in particular of the cooling circuit, since the oil no longer has to be cooled or heated when flowing through the coolant heat exchanger,
- Reduction of the manufacturing, maintenance, and operating costs of the cooling circuit since the amount of oil can be optimized and therefore minimized, as well as a
- Reduction of space requirement of the cooling circuit as a whole.

BRIEF DESCRIPTION OF THE DRAWINGS

Further details, characteristics, and advantages of the embodiments of the invention follow from the following description of exemplary embodiments, with reference to the respective drawings. Respectively shown are devices for the separation of oil from a coolant-oil mixture with a heat exchanger for cooling the oil and for cooling and/or liquefying the coolant in a cooling circuit, as well as a mechanical device positioned inside a first manifold of a heat exchanger for separating the oil from the coolant-oil mixture, with.

DETAILED DESCRIPTION OF THE PREFERRED EMBODIMENT

The two components of coolant and oil of the coolant-oil mixture are mechanically separated from each other by means of a separating device. The oil is separated from the coolant-oil mixture such that after separation, there are a high-coolant component and a high-oil or respectively low-coolant component. The high-coolant component is also referred to succinctly as coolant, whereas the high-oil component is also referred to succinctly as oil.

The mechanical separation is based on the force of inertia as a driving force, which requires a sufficiently large difference in density between the two components intended for separation. A sufficiently large difference in density between the oil and the coolant, the two components intended for separation, exists in the cooling circuit at the outlet of the compressor and at the inlet of the heat exchanger operating as condenser/gas cooler.

If the liquefaction of the coolant is done at subcritical operation, such as, for instance, with the R134a coolant or, under certain environmental conditions, with carbon dioxide, the heat exchanger is referred to as a condenser. Part of the heat exchange takes part at a constant temperature. In case of supercritical operation, or respectively, of supercritical heat dissipation in the heat exchanger, the temperature of the coolant steadily decreases. In this case, the heat exchanger is also referred to as a gas cooler. Under certain environmental conditions and modes of operation of the cooling circuit, supercritical operation may occur, for instance, with carbon dioxide as coolant.

The two now separated components of coolant and oil, and specifically, the high-coolant and high-oil components, are respectively cooled when flowing through the condenser/gas cooler, with the components being guided through different areas of the heat exchanger, separated from each other. The areas feature different dimensions. The area with the larger dimensions is flooded with the high-coolant component, and the area with the smaller dimensions is flooded with the high-oil component.

Figure 1:
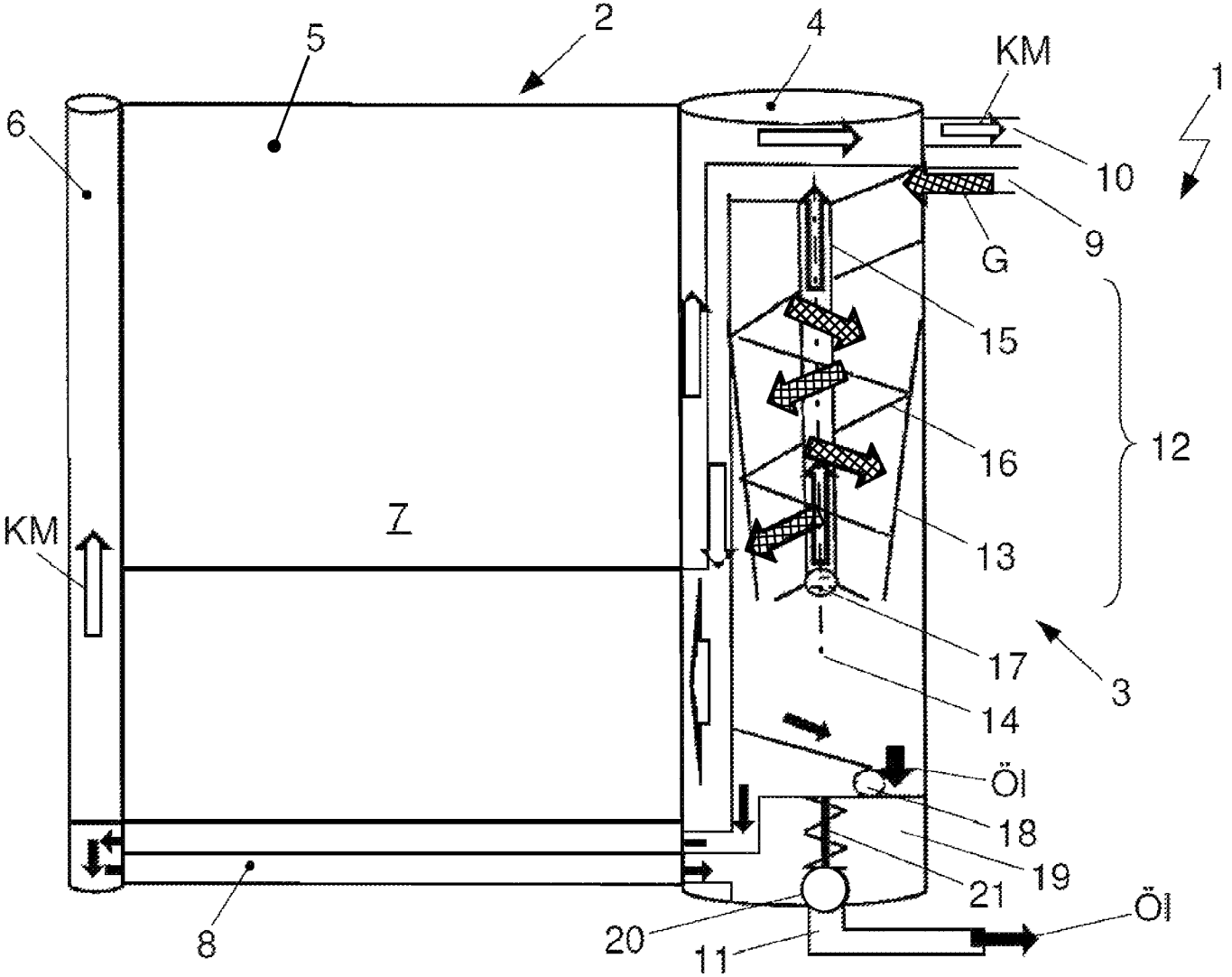
FIG. 1: a mechanical device for separating the oil with a cyclone separator.

FIG. 1 shows a device 1 for separating oil from a coolant-oil mixture G of a cooling circuit, featuring a heat exchanger 2, operated as a condenser/gas cooler, for cooling and/or liquefying the coolant and for cooling the oil, as well as a mechanical device 3 for separating oil from a coolant-oil mixture G, which is integrated inside a first manifold 4 of the heat exchanger 2. The first manifold features an inlet for the coolant-oil mixture, such that the device is positioned downstream from the compressor in the flow direction of the coolant-oil mixture, and upstream from the various areas of the heat exchanger for conditioning the oil and the coolant.

The heat exchange surface 5 of the heat exchanger 2 is divided into two areas 7, 8 of different dimensions. The first area 7, which is larger dimensioned, is flooded by the high-coolant component. The coolant is at least to a significant degree liquefied when flowing through the heat exchanger 2. The second area 8, which is smaller dimensioned, is flooded by the high-oil component, which is cooled when flowing through the heat exchanger 2.

The device 3 for separating the oil, also known as oil separator 3, features an inlet for the coolant-oil mixture G. the inlet is connected with a compressor (not shown) of the cooling circuit by means of a connecting line 9. The connecting line 9 corresponds to the pressure line of the compressor.

The coolant-oil mixture G flows tangentially into the device 3 via the connecting line 9. The device 3 is designed in the area 12 of the oil separation as a cyclone separator with a wall 13 shaped as a circular cylinder or as a truncated cyclical cone. The area 12 of the oil separation that is enclosed by the wall 13 therefore features an increasing, decreasing, or constant area for the coolant-oil mixture G intended to be separated into the components. Depending on the embodiment or on the change in the flow area, the flowing speed of the coolant-oil mixture G when flowing through the cyclone separator 12 is steadily increased, decreased, or not changed at all, meaning that it remains constant.

In the center of the cyclone separator 12, coaxially to the central axis 14 of the wall 13, there is a tube 15 in the shape of a circular cylinder, such that the flow area of the coolant-oil mixture G intended for separation is delineated on one side by the outer surface of the tube 15, and on the other side by the wall 13.

Between the outer surface of the tube 15 and the wall 13, there is also a spirally winding flow path 16. Depending on the upward or downward design of the flow path 16, the flow area of the coolant-oil mixture G intended to be separated, and consequently the flow speed, may vary. The flow area may increase in the flow direction, it may decrease, or it may remain constant.

Depending on the embodiment of the device 3, the connecting line 9 ends as an inlet for the coolant-oil mixture Gin the cyclone separator 12 in the upper part, as in FIG. 1, or in the lower part, which is not shown. Due to the inlet, which is positioned tangentially to the central axis 14 and to the inner contour of the cyclone separator 12, the coolant-oil mixture G is set into a cyclical motion. Due to the impact of the centrifugal force, the coolant-oil mixture G is separated into a coolant-rich and into an oil-rich component. The separated coolant-rich component is guided upward via tube 15, also referred to as riser tube, due to its lower density. At the inlet into tube 15, a filter element 17 is provided, for instance in the form of a screen, such that the coolant-rich component flows into the riser tube 15 through the screen. The separated oil-rich component is diverted downward out of the cyclone separator 12. The oil-rich component is also guided through a filter element 18, specifically one embodied as a screen.

After flowing out of the cyclone separator 12, the coolant KM, or respectively, the coolant-rich component, is guided in the first manifold 4 to the first area 7 of the heat exchanger 2. The coolant KM is guided to the second manifold 6, is diverted in the second manifold 6, and flows back to the first manifold 4. The coolant KM exits the device 1 via the connecting line 10, and is guided to an expansion organ or to an internal heat exchanger of the cooling circuit.

After flowing out of the cyclone separator 12, the oil, or respectively, the oil-rich component, is guided in the first manifold 4 to the second area 8 of the heat exchanger 2. The oil is guided to the second manifold 6, where it is diverted, and made to flow back to the first manifold 4. The cooled oil-rich component is collected in the lower part of the first manifold 4 and subsequently exits the device 1 via the connecting line 11, and is guided to the compressor of the cooling circuit. The lower part of the first manifold 4 is designed as an oil reservoir 19.

Inside the oil reservoir 19, a float 20 is embodied as a sealing element of the oil reservoir 19 in the direction of the connecting line 11. The float 20 is supported by a guiding element 21. The guiding element 21 advantageously features a spring element, of which the spring force acts on the float 20 so as to close the oil reservoir 19.

The float 20 seals off the connecting line 11 to the compressor, specifically when the oil level in the oil reservoir 19 is too low, in order to avoid a coolant bypass though the device 3 from the high pressure side of the cooling circuit to the low pressure side of the cooling circuit.

The design of the float 20 so as to avoid a coolant bypass is identical in all the following embodiments for a mechanical separation of the coolant-oil mixture G. The various embodiments may also be designed without the float 20, in which case the coolant bypass may be directed, for example, to the compressor via the selection of the internal diameter of the connecting line 11.

Figure 2:
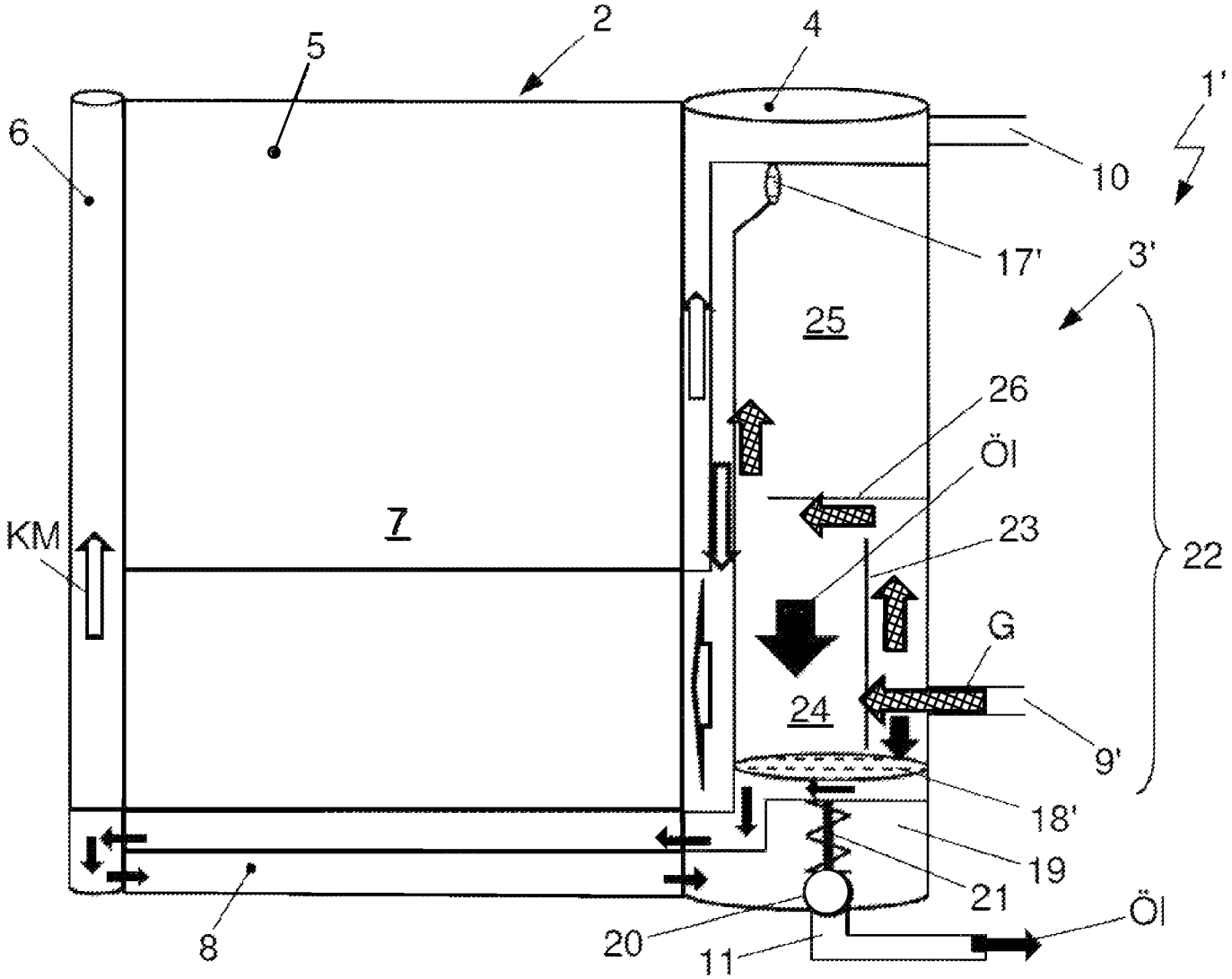
FIG. 2: a mechanical device for separating the oil with a deflector plate and a J-shaped tube for diverting the coolant.

FIG. 2 shows a device 1' for separating oil from a coolant-oil mixture G of a cooling circuit, featuring a heat exchanger 2 for cooling and/or liquefying the coolant and for cooling the oil, as well as a mechanical device 3' for separating oil from a coolant-oil mixture G. The device 3' is integrated inside a first manifold 4 of the heat exchanger 2.

The device 1' for heat exchanging and for separating oil from a coolant-oil mixture from FIG. 2 differs from the device 1 from FIG. 1 in the design of the device 3' for separating the oil, specifically in the design of the oil separation area 22.

The connecting line 9' with the compressor of the cooling circuit is oriented as an inlet, or respectively as a feed line, for the coolant-oil mixture G, perpendicularly to a deflector plate 23 located inside the area 22. After flowing into the device 3', the coolant-oil mixture G hits the front side of the deflector plate 23. Due to the abrupt changes in the flow speed and in the flow direction, a first high-coolant component and a first high-oil component are separated from each other as a result of the different forces of inertia of the high-coolant component and the high-oil component, which cause the two components to change direction in a different manner.

The first high-oil component is primarily diverted downward at the deflector plate 23 through a lower branch into the lower part of the oil separation area 22. The first high-coolant component, after hitting the deflector plate 23, is primarily diverted upward through an upper branch. The two branches are brought back together on the rear side of the deflector plate 23, where a first chamber 24 is provided. The first chamber 24 features a significantly larger flow area than the upper branch for the first high-coolant component located after the deflector plate 23 in the flow direction. Due to the increase of the flow area at the transition point from the upper branch to the first chamber 24 and the resulting decrease of the flow speed, a second high-oil component is separated from the first high-coolant component and diverted downward.

The first chamber 24 is separated by a separator plate 26 from a second chamber 25. The second chamber 25 is located above the first chamber 24. The chambers 24, 25, are connected with each other an opening in the separator plate 26.

A third high-oil component is separated from the second high-coolant component, which flows through the opening from the second chamber 25 to the second chamber 25 as it flows through the second chamber 25, and diverted downward. The additional separation of the oil is forced by a vertical flow of the second high-coolant component through the second chamber 25.

The separated high-oil components are guided downward through the lower branch, the first chamber 24, and the second chamber 25 into the device 3', combined, and then guided through a filter element 18' in the form of a screen. The remainder of the flow path and the conditioning of the high-oil component correspond to the explanations for device 1 in FIG. 1.

The high-coolant component remaining after flowing through the second chamber 25 is diverted via a tube, in particular a J-shaped tube, and via a filter element 17', for example in the form of a screen, out of the oil separation area 22. The remainder of the flow path and the conditioning of the high-coolant component correspond to the explanations for device 1 in FIG. 1.

Figure 3A:
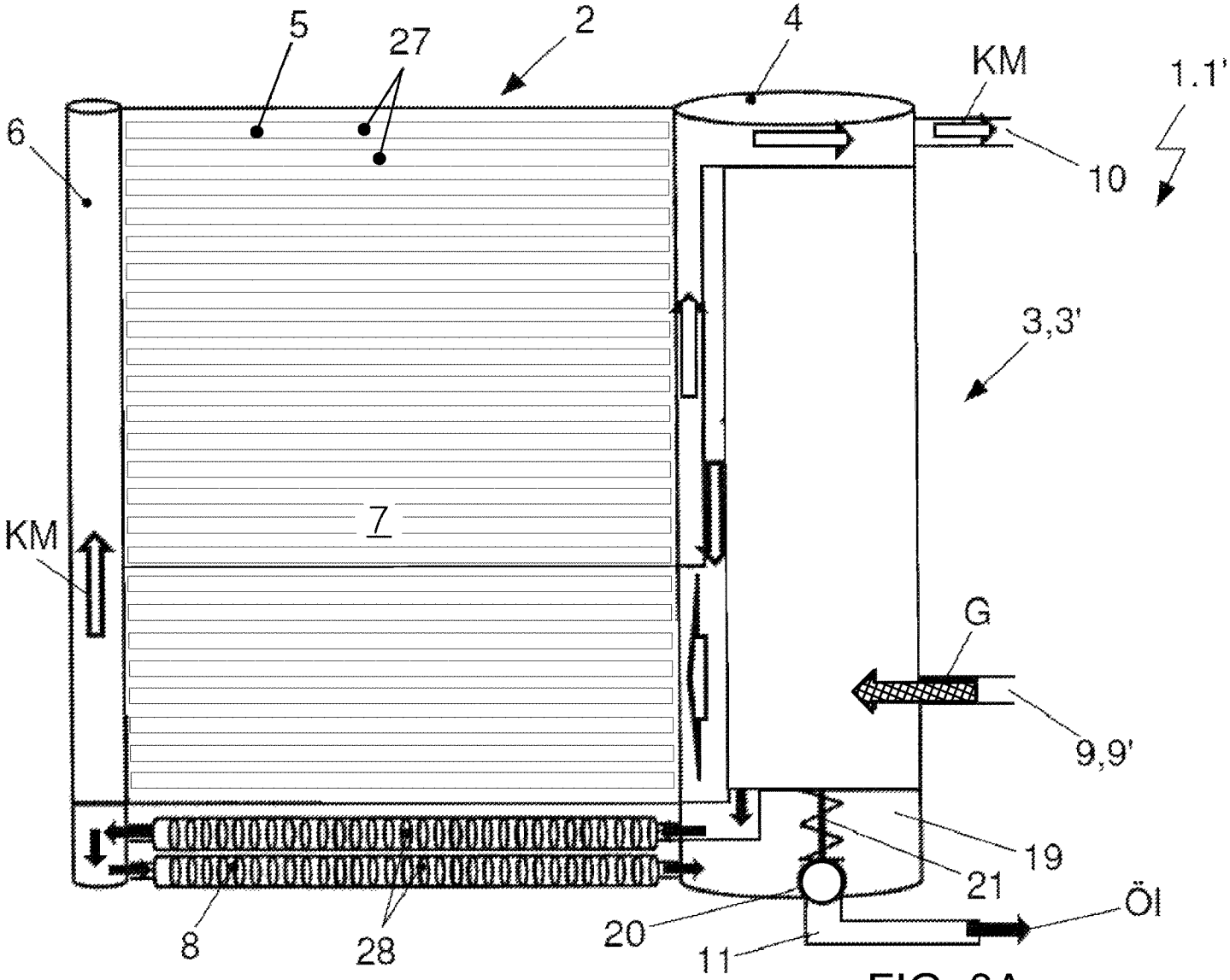
FIG. 3A, 3B, 3C: a heat exchanger with different areas for cooling the oil and for cooling and/or liquefying the coolant after the separation of the oil from the coolant-oil mixture.
Figure 3B:
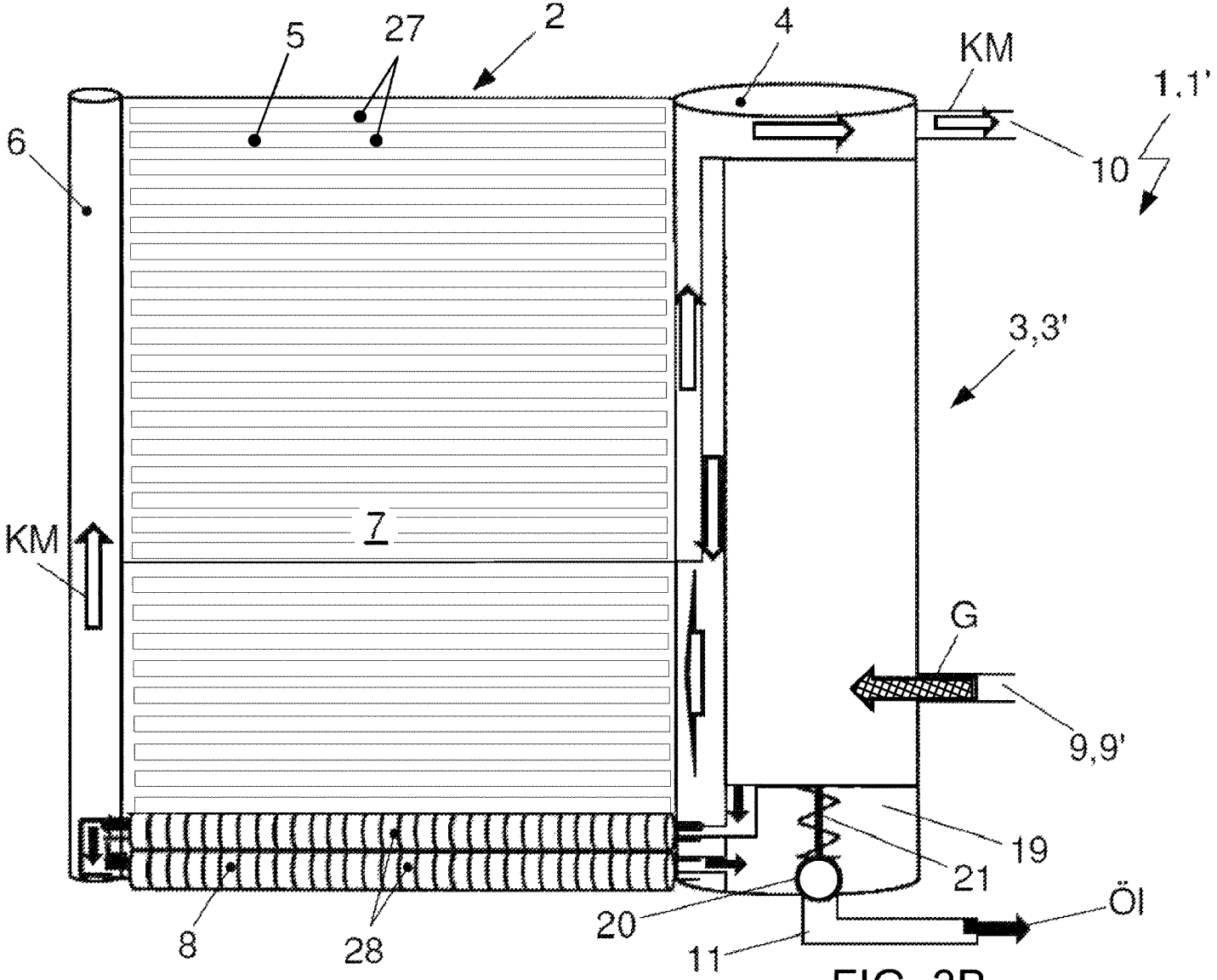
Figure 3C:
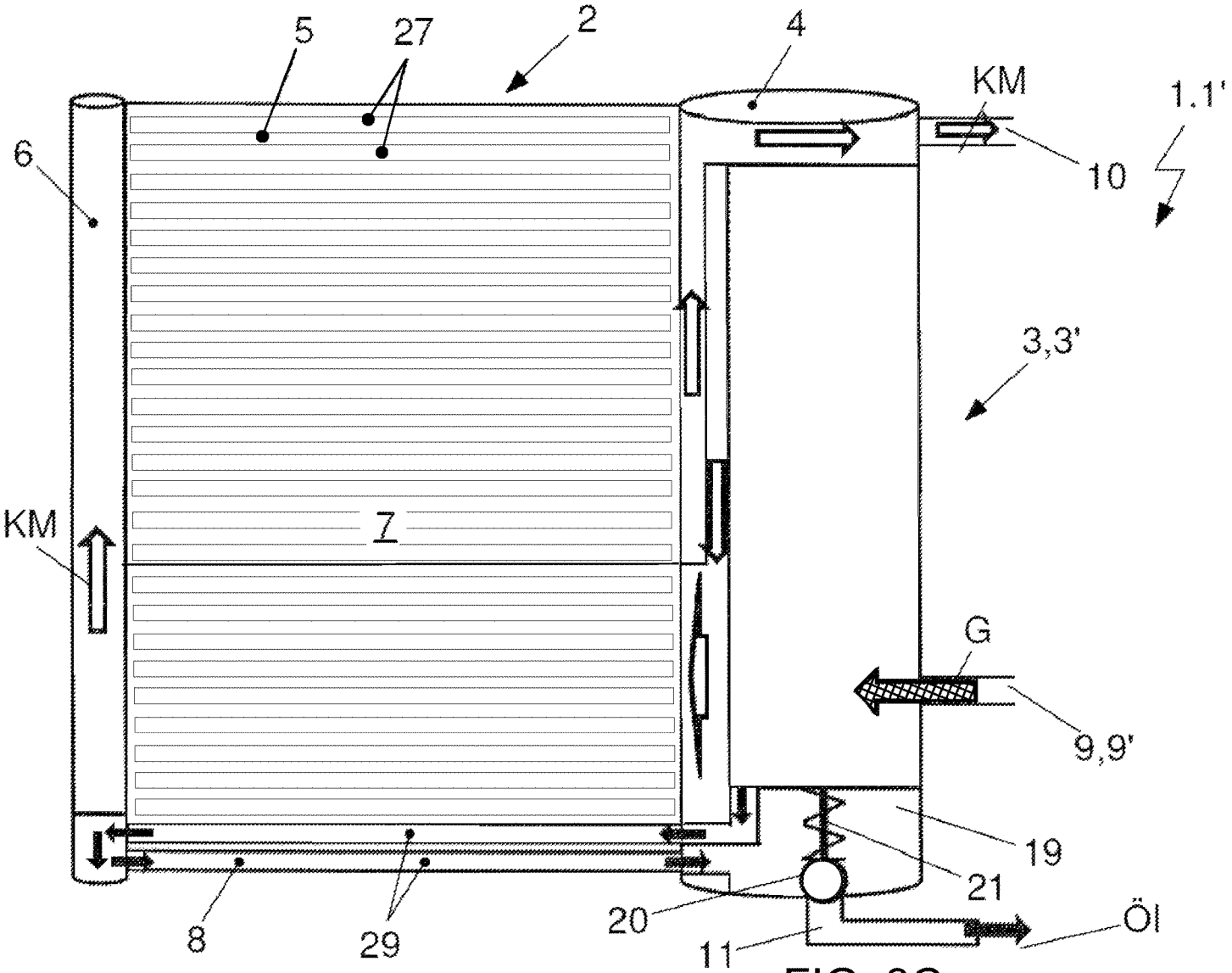

FIGS. 3A through 3C each show a device 1, 1' for separating oil from a coolant-oil mixture G of a cooling circuit, featuring a heat exchanger 2, operated as a condenser/gas cooler, for cooling and/or liquefying the coolant and for cooling the oil, as well as a mechanical device 3, 3' for separating oil from a coolant-oil mixture G. The integration of the device 3, 3' inside a first manifold 4 of the heat exchanger 2 follows from FIGS. 1 and 2.

The heat exchanger 2 is designed as a condenser/gas cooler with an integrated oil cooler. The heat exchange surface 5 of the heat exchanger 2 is subdivided into two partial surfaces, and therefore into two areas 7, 8 of different dimensions.

After the separation of the oil from the coolant-oil mixture G inside the mechanical oil separator 3, 3', the two components, that is, the high-coolant component and the high-oil component, are cooled or respectively conditioned separately from each other. The high-coolant component flows through the first, larger-dimensioned, area 7, where the coolant is liquefied. The high-oil component is guided through the second, smaller-dimensioned, area 8, where it is cooled.

The first area 7 is equipped with flat tubes 27 which extend between the manifolds 4, 6. The high-coolant component is guided through the flat tubes 27, which are advantageously designed as multichannel tubes. In the gaps between the outer surfaces of adjacent flat tubes 27, fins are provided.

The second area 8 features finned tubes 28, which extend between the manifolds 4, 6 as well. The high-oil component is guided through the finned tubes 28.

In each of the areas 7, 8 of the heat exchanger 2, the heat is transferred to the ambient air flowing past the heat exchange surface 5.

In the embodiment of the device 1, 1' according to FIG. 3A, the areas 7, 8 of the heat exchanger 2, and therefore the flat tubes 27 of the first area 7 and the finned tubes 28 of the second area 8, are arranged in a shared single plane. The ambient air flows parallel through the areas 7, 8.

In the embodiment of the device 1, 1' according to FIG. 3B, the areas 7, 8 of the heat exchanger 2, and therefore the flat tubes 27 of the first area 7 and the finned tubes 28 of the second area 8, are arranged in two planes positioned parallel to each other.

The front surfaces of the flat tubes 27 of the first area 7 extend over the entire length of the manifolds 4, 6, such that the flat tubes 27 are arranged in a first plane.

The finned tubes 28 of the second area 8, which are flooded by the high-oil component, are arranged in a second plane, which is spaced from the first plane formed by the flat tubes 27, and positioned before or behind the first plane, in the direction of the ambient air flow.

Accordingly, the ambient air flows first past the heat exchange surface of the first area 7 and then past the heat exchange surface of the first area 8, or vice versa, depending on the direction of the flow.

Other than in the embodiments according to FIGS. 3A and 3B, in the embodiment of the device 1, 1' according to FIG. 3C, in addition to the first area 7, also the second area 8 of the heat exchanger 2 is made out of flat tubes 29 extending between the manifolds 4, 6. Accordingly, in addition to the high-coolant component flowing through the flat tubes 27, the high-oil component is guided through flat tubes 29 as well, which are advantageously designed as multichannel tubes. In the gaps between the outer surfaces of adjacent flat tubes 29, fins are provided.

REFERENCE LIST

1, 1' Device for separating and cooling oil and cooling and/or liquefying coolant
2 Heat exchanger
3, 3' Device for separating the oil, oil separator
4 First manifold
5 Heat exchange surface
7 Second manifold
7 First area of the heat exchanger, condenser/gas cooler
8 Second area of the heat exchanger, oil cooler
9, 9' Connecting line for coolant-oil mixture G, with compressor
10 Connecting line for coolant
11 Connecting line for oil
12 Oil separation area, cyclone separator
13 Wall
14 Central axis
15 Tube, riser tube
16 Flow Path
17, 17' Filter element
18, 18' Filter element
19 Oil reservoir
20 Float
21 Guiding element for the float
22 Oil separation area
23 Deflector plate
24 First chamber
25 Second chamber
26 Separator plate
27 Flat tube
28 Finned tube
29 Flat tube
KM Coolant, high-coolant component
Öl Oil, high-oil component
G Coolant-oil mixture

What is claimed is:

1. A heat exchanger comprising:

a device for separating an oil from a coolant-oil mixture and cool the oil and cool and/or liquefy the coolant;

a first area configured to cool and/or liquefy the coolant; and a second area configured to cool the oil, wherein the heat exchanger includes at least two manifolds, wherein the first area of the heat exchanger includes first flow channels configured to guide the coolant, wherein the second area of the heat exchanger includes second flow channels configured to guide the oil, the first flow channels and the second flow channels extending between the manifolds, wherein each of the first flow channels and the second flow channels has a respective outside configured to be flooded by a heat-absorbing fluid, wherein the device for separating the oil is disposed inside a first one of the manifolds, the first one of the manifolds including an inlet for the coolant-oil mixture and an outlet for the coolant, wherein the device for separating the oil is positioned upstream from the first area and the second area of the heat exchanger;

wherein the first area includes a first portion and a second portion, where the flow directions of the coolant in each of the first portion of the first area and the second portion of the first area are opposite to each other, wherein an outlet of the device for separating the oil is adjacent to the first portion of the first area and the outlet for the coolant is in direct fluid communication with the second portion of the first area, wherein the inlet for the coolant-oil mixture is arranged adjacent to and parallel to the outlet for the coolant, wherein the inlet for the coolant-oil mixture and the outlet for the coolant are disposed at a first end of the first one of the manifolds and the outlet of the device for separating the oil is disposed at a second end of the first one of the manifolds, and wherein the coolant-oil mixture is separated within the device for separating the oil, the coolant flows through a first passageway downstream of the inlet of the device for separating the oil to the first portion of the first area, the coolant flows from the second portion of the first area to the outlet for the coolant through a second passageway, wherein the first one of the manifolds includes the first passageway and the second passageway, and wherein the first passageway and the second passageway are directly adjacent and parallel with each other.

2. The heat exchanger according to claim 1, wherein the first flow channels of the first area and the second flow channels of the second area are each arranged in a single plane.

3. The heat exchanger according to claim 2, wherein the first flow channels of the first area and the second flow channels of the second area form a joint plane, and wherein the heat exchanger is configured such that if there is a flow of the heat-absorbing fluid, it will flow around the first flow channels of the first area and the second flow channels of the second area in parallel.

4. The heat exchanger according to claim 2, wherein the first flow channels of the first area and the second flow channels of the second area form different planes arranged parallel to and spaced from each other, and wherein the heat exchanger is configured such that if there is a flow of the heat-absorbing fluid, it will flow consecutively around the first flow channels of the first area and the second flow channels of the second area.

5. The heat exchanger according to claim 1, wherein the device for separating the oil is a cyclone separator and the coolant-oil mixture configured to flow tangentially into the device for separating the oil.

6. The heat exchanger according to claim 5, wherein the device for separating the oil includes a wall shaped as a truncated cyclical cone having an area fully enclosed by the wall including a flow area for the coolant-oil mixture to be separated, the flow area increasing or decreasing in a direction of a flow of the coolant-oil mixture.

7. The heat exchanger according to claim 5, wherein the device for separating the oil includes a spirally winding flow passage having a gradient, wherein the gradient of the flow passage decreases in the flow direction.

8. The heat exchanger according to claim 1, wherein the device for separating the oil includes an inlet receiving the coolant-oil mixture, a deflector plate, at least one chamber, and a J-shaped tube for diverting the coolant, wherein the deflector plate is perpendicular to a direction of flow of the coolant-oil mixture, downstream from the inlet, and delineates an upper branch, a lower branch, and the chamber, and wherein the upper branch leads into the chamber, the chamber featuring a larger flow cross section than the upper branch.

9. The heat exchanger according to claim 1, wherein the device for separating the oil includes a device for sealing a connecting line to a compressor.

* * * * *